US005787620A

United States Patent [19]

Swanson et al.

[11] Patent Number: 5,787,620

[45] Date of Patent: Aug. 4, 1998

[54] SCROLLED SIGN MODULE

[75] Inventors: Jerome Swanson, Cannon Falls; Kenneth Swanson, Apple Valley, both of Minn.

[73] Assignee: LaCrosse Sign Co., Onalaska, Wis.

[21] Appl. No.: 639,936

[22] Filed: Apr. 19, 1996

[51] Int. Cl.[6] ..... G09F 11/18

[52] U.S. Cl. ..... 40/521; 40/518; 192/69.81

[58] Field of Search ..... 40/519, 518, 521; 192/69.81

[56] References Cited

U.S. PATENT DOCUMENTS

| | | | |
|---|---|---|---|
| 594,725 | 11/1897 | Bundy | 40/519 X |
| 656,478 | 8/1900 | Schaffer et al. | 40/519 |
| 1,247,589 | 11/1917 | Shure | 40/521 |
| 1,376,749 | 5/1921 | Edison | 40/521 |
| 2,271,673 | 2/1942 | Zenner | 192/69.81 X |
| 2,658,396 | 11/1953 | Christiance | 192/69.81 X |
| 2,742,127 | 4/1956 | Mumford et al. | 192/69.81 |
| 3,780,458 | 12/1973 | Jacoby et al. | 40/519 X |
| 4,635,773 | 1/1987 | Llewellin | 192/69.81 X |
| 5,412,893 | 5/1995 | Aiken, Sr. | 40/518 |

*Primary Examiner*—Kenneth J. Dorner
*Assistant Examiner*—Andrea Chop
*Attorney, Agent, or Firm*—D. L. Tschida

[57] ABSTRACT

A back lit alphanumeric sign module having a printed web which includes opaque and transparent regions that define alphanumeric characters. The web is trained between end plates having illumination cutouts and which support a spring biased take-up-roller, drive roller, a pair of transparent idler rollers and tie rods. A spiral wound spring at the take-up roller continuously tensions the web. A biased latch arm and slot at the take-up and drive rollers define web stop limits. A split, spring biased ratchet collar is provided in manual modules. The split ratchet collar at the manual drive roller provides a one-way geared rotation and cooperates with a pole engaged loop to vary rotation and sign information. A pulse modulated motor controller drive is provide at the electric module. A remote controller at the electronic module provides programmed and operator entered spread spectrum drive signals over a power line carrier circuit to the drive motor to vary sign information. Sensed position indicia at the web center the characters to a viewing window of the back lit enclosure. The modules are constructed to be rack mounted in a variety of stacked organizations.

10 Claims, 7 Drawing Sheets

SCROLLED SIGN MODULE

BACKGROUND OF THE INVENTION

The present invention relates to back lit outdoor signs and, in particular, to modules containing an alphanumeric web that can be manually or remotely scrolled.

Varities of sign assemblies are known which include alphanumeric webs that are trained between supply and take-up rollers. The sign webs include pre-printed lettered regions that contain discrete letters or pre-printed messages. Most typically such displays are limited to indoor or protected locations. The viewing area is relegated to short messages, for example, geographic destinations, products and prices or other limited length messages.

Billboard signage or signs intended to be read from relatively long distance, whether for indoor or outdoor viewing, typically provides an arrangement of individual alphanumeric characters at a letter board. The messages may be hand painted or mounted to a sign board. The sign board may contain slide tracks or other cooperating fastener systems to individually restrain each letter to the sign board. The sign board can be supported in an elevated location via a pylon, supporting fixtures and fasteners to a building or other super structure. A desired message is created through a series of sequentially arranged placard type letters.

Illumination may also be provided in relation to the front or rear of the sign board. U.S. Pat. Nos. 4,110,925; 4,680,883; 4,707,938; 4,741,118; 4,995,183; 5,003,717; and 5,174,055 disclose sign assemblies containing lettered webs having transparent alphanumeric characters defined within opaque bordering regions. Various manual and remote controllers cooperate with the webs to position the characters relative to a viewing window.

Shortcomings of the foregoing assemblies arise from the relatively complex electromechanical drive linkages which are required at each module. The rather elaborate internal mechanisms and surrounding housings also tend to create shadows and sub-optimal illumination of the displayed characters. The development of meaningful signage through the concatenating of multiple modules also requires rather extensive drive linkages and control mechanisms to establish a desired message and permit the changing of the message.

In distinction to known assemblies, the present invention was developed to provide individual letter modules which can be arranged to a supporting, back lit enclosure. The characters at each module are independently established upon scrolling a spring biased alphanumeric web past a viewing window. Positioning can be affected with a manual, one-way ratcheted drive roller or remote, spread spectrum controller.

SUMMARY OF THE INVENTION

It is a primary object of the present invention to provide a sign character module that is adaptable to back lit illumination within an enclosure containing a number of modules and wherein each module displays one or more alphanumeric characters.

It is a further object of the invention to provide a character module having a spring biased, rolled web.

It is a further object of the invention to provide a ratcheted drive roller which cooperates with a take-up roller that supports the web under continuous tension.

It is a further object of the invention to provide a module including stop limits at the drive and take-up rollers.

It is a further object of the invention to provide a web support assembly having large voids and having a web that is trained about transparent idler rollers and which optimally prevents shadows at the illuminated characters and transfers internal illumination between modules.

Various of the foregoing objects, advantages and distinctions of the invention are particularly obtained in a present construction which provides a pair of top and bottom end plates having large voids that are displaced by a pair of tie rods. An alphanumeric web is trained over a pair of transparent idler rollers and between a drive roller and a spring biased take-up roller. A spiral wound torsion spring at the take-up roller places the roller under constant tension. Each of the rollers includes flanged ends to retain and guide the web at the rollers. The web includes a number of reverse print alphanumeric characters that are defined as transparent regions within an opaque field.

The modules are arrangeable to tiered racks and a surrounding enclosure contains an illumination source which back lights each character. Voids in the support assembly and attendant transparent idler rollers efficiently distribute internal illumination to back light the transparent characters without shadow in an enclosure containing numerous modules.

In a manually advanced module, a split, ratchet collar at an axle of the drive roller cooperates with the take-up roller to control the advance of the web. Stop limits at each of the drive and take-up rollers prevent web breakage. A control rod can be engaged to a loop of the drive roller to rotate the drive roller via a unidirectional geared ratchet or to separate the ratchet collar to obtain reverse rotation and corresponding extraction or retraction of the web.

In a remotely controlled electonic module, a spread spectrum controller provides programmed control signals over power supply conductors to contained stepper motors. Upon confirming proper module identification, pulse width modulated drive signals operate the motors to advance and retract the contained web. Optical sensors and transparent markers, which separate the characters, provide position data to the controller.

Still other objects, advantages and distinctions of the invention are more apparent from the following description with respect to the appended drawings. To the extent various modifications and improvements have been considered, they are described as appropriate. The following description should not be literally construed in limitation of the invention. Instead, the invention should be broadly interpreted within the scope of the further appended claims.

DESCRIPTION OF THE PREFERRED EMBODIMENT

Figure 1:
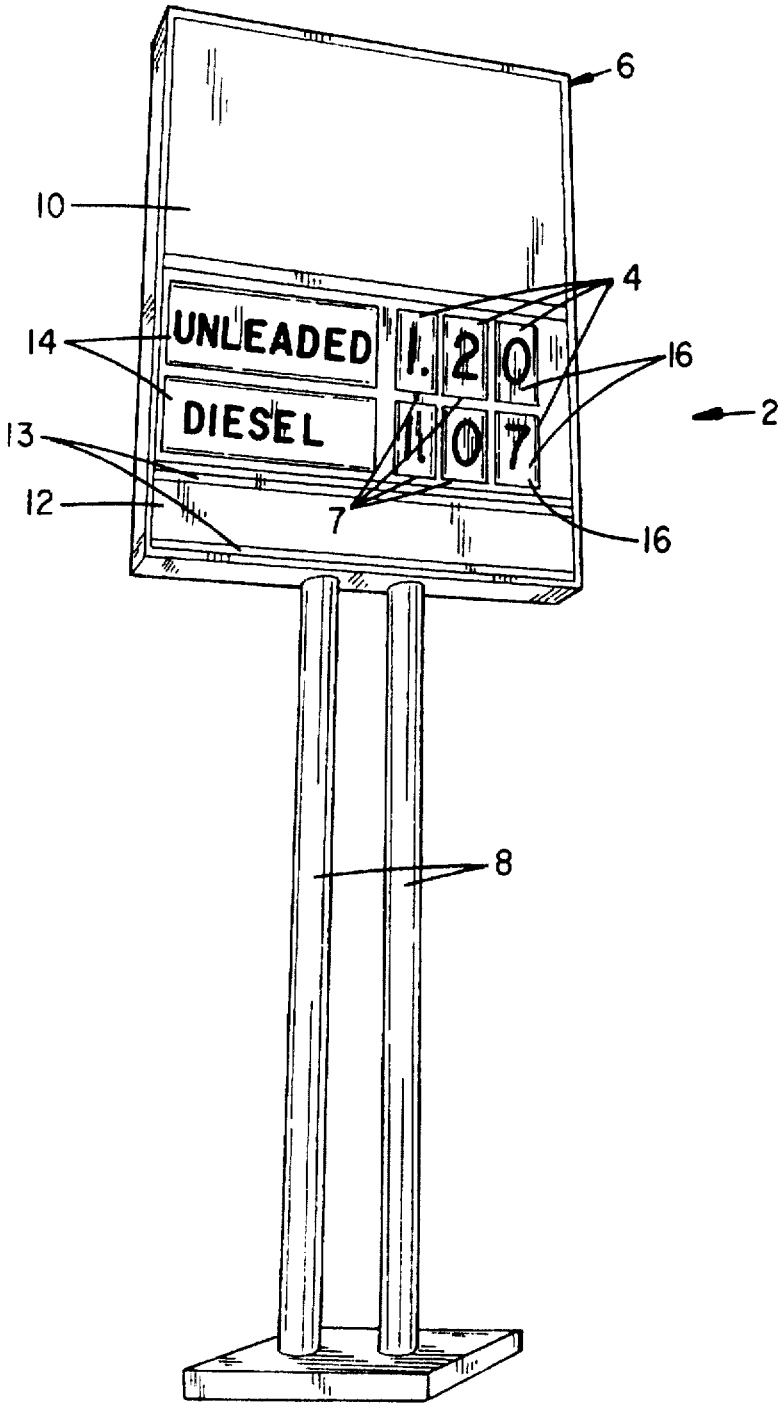
FIG. 1 is a perspective drawing of a typical pylon mounted, back lit sign wherein each alphanumeric character is defined by a modular sign assembly of the invention.

FIG. 1 depicts a perspective view of a modular sign 2 constructed of a number of scrolled alphanumeric modules 4 of the invention. The modules 4 are fitted to a support frame or rack 5, reference FIG. 6, contained within a surrounding, weather resistant, back illuminated enclosure 6. In normal application a number of modules 4 are secured side-by-side and/or on top of each other to the rack assembly 5 to be visible at windows 7 aligned to the modules 4. The signage modules 4 find most advantageous application where large characters are desired.

A pair of pylons 8 support the enclosure 6 to permit viewing from relatively large distances. The sign 2 finds particular use to display fuel prices, such as for gasoline and diesel fuel, and the letters are sized to be visible by passing motorists.

The fuel prices displayed at each module 4 can be changed as required. Each module 4 displays a single numeral. A scrolled web 16 of each module 4 includes a number of numeric characters alone or with an appropriate decimal point or dollar sign.

Additional, permanent characters or messages may also be displayed at the enclosure 6 in relation to the changeable characters. The name of the business or fixed messages can be displayed at included display panels 10, 12.

For example, the panel 10 might be a screen printed permanent panel identifying the business and the panel 12 might provide information to monthly/weekly specials or particular products. The panel 12 might also provide track rails 13 to provide a letter board which receives conventional sign letters. The dollar sign and decimal point of each product price might also be permanently printed at the enclosure 6.

Figure 2:
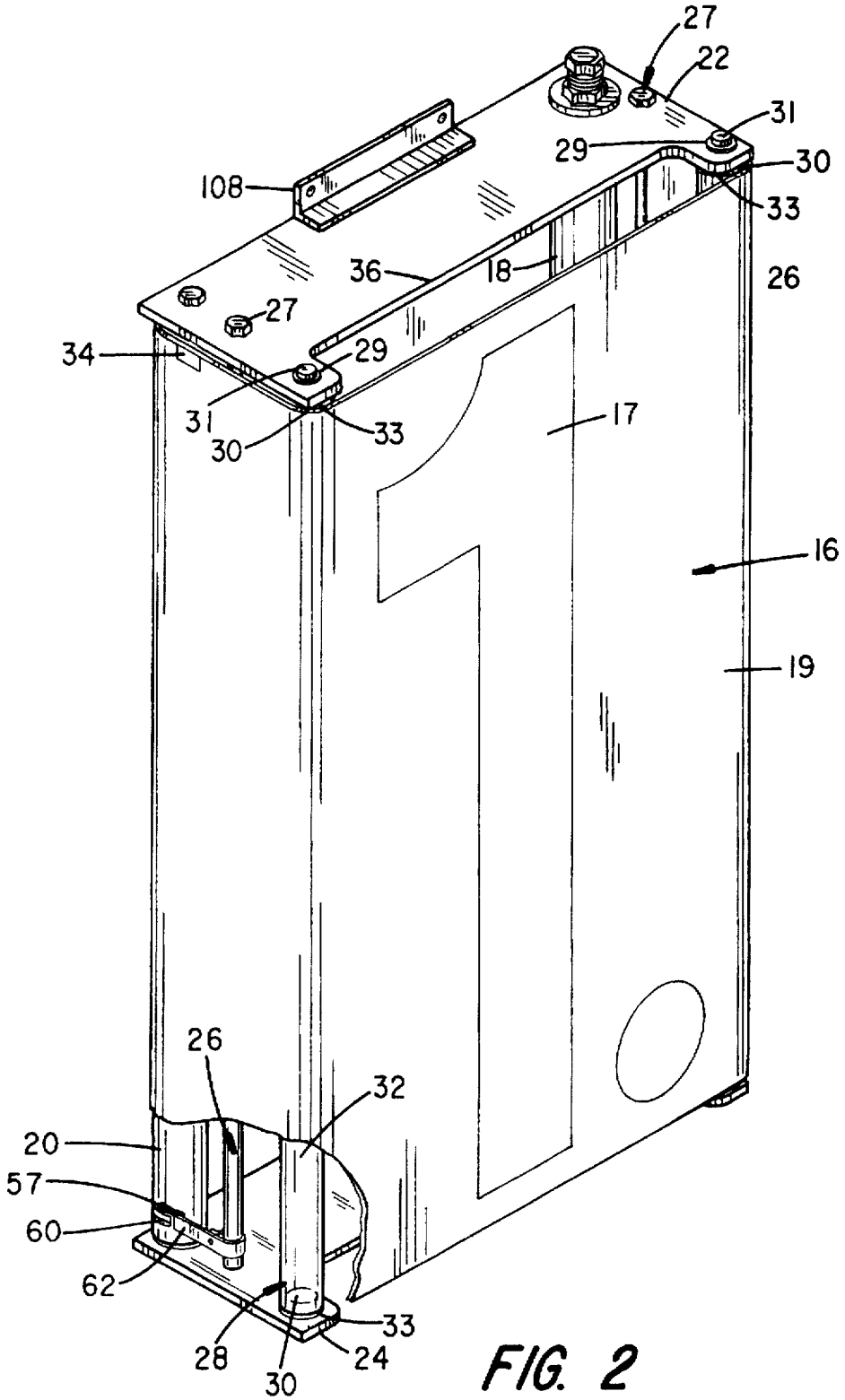
FIG. 2 is a perspective drawing of a single modular sign character, removed from the sign enclosure and shown in partial cutaway.
Figure 3:
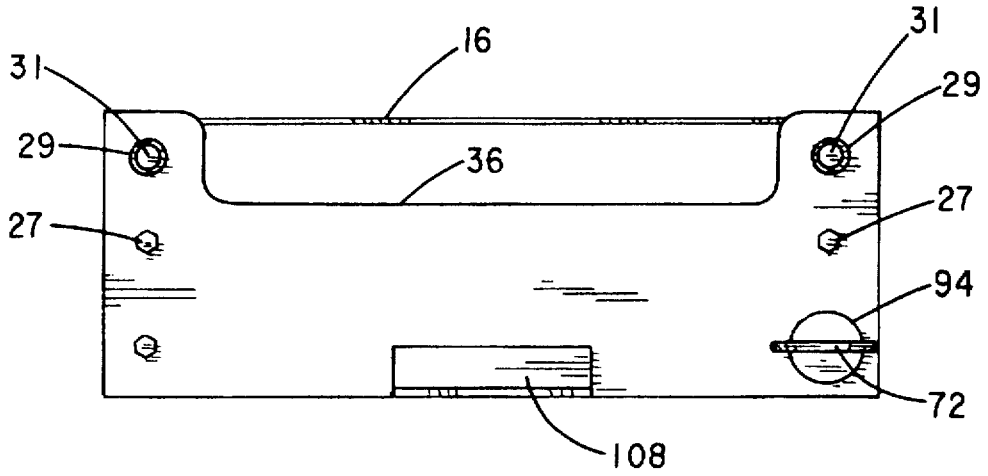
FIG. 3 is a bottom elevation view of a sign module.
Figure 4:
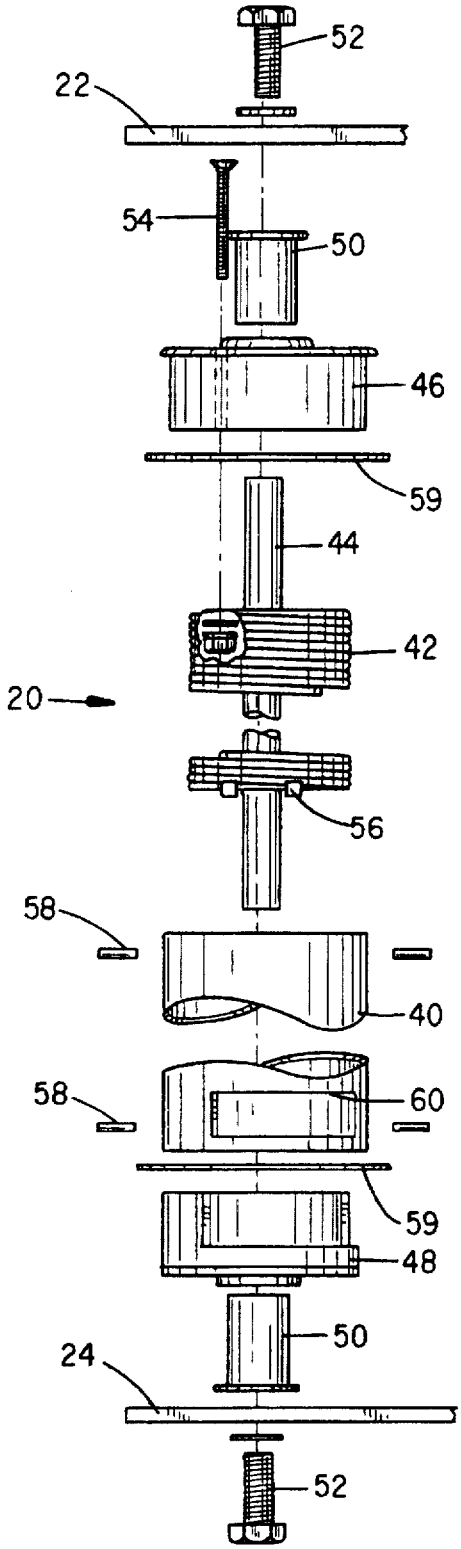
FIG. 4, is an exploded assembly drawing to the construction of the take-up roller.
Figure 5:
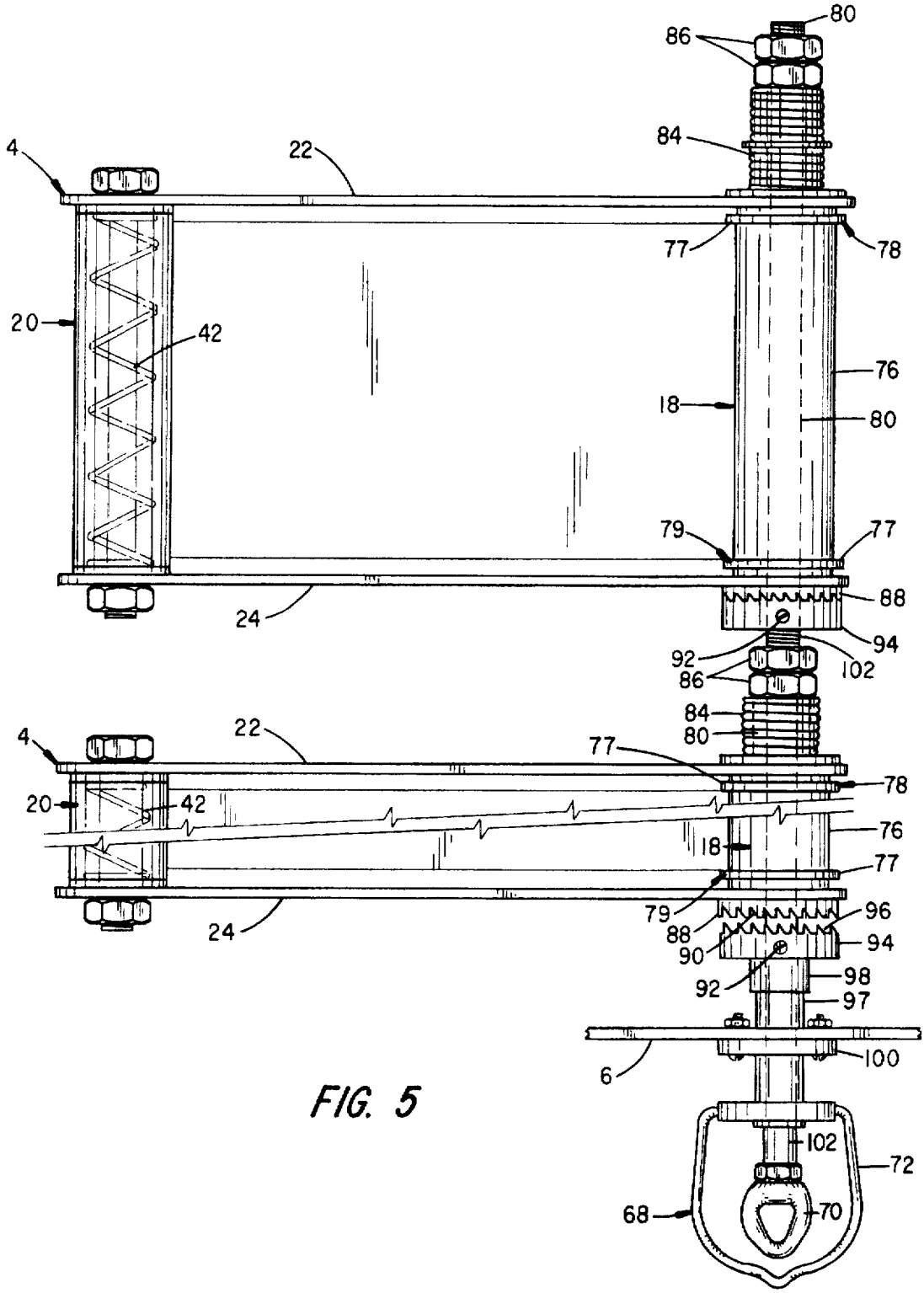
FIG. 5 is a view of a pair of vertically arranged, manually directed modules, wherein the take-up and drive rollers are shown in cross section.

With additional attention to FIGS. 2 through 5, FIG. 2 depicts a perspective drawing to a single module 4. FIG. 3 depicts a bottom view of the module 4 and FIGS. 4 and 5 depict assembly drawings to the drive and take-up roller assemblies 18, 20. With attention to FIG. 2 and 3, each module 4 includes a pair of top and bottom end plates 22, 24 which are displaced from one another a fixed distance with a number of tie rods 26. The tie rods 26 essentially consist of fixed length rods that are secured to the end plates 22, 24 with threaded fasteners 27.

The drive roller 18 and take-up roller 20 are mounted to aft corners of the end plates 22, 24. A pair of transparent idler rollers 28 are set forward of the drive and take-up rollers 18, 20. The web 16 is trained between the drive and take-up rollers 18, 20 and over the idler rollers 28.

The idler rollers 28 include end caps 30 which rotate at the end plates 22, 24 and are fitted to clear acrylic tubes 32. The tube material is selected to be non-abrasive relative to the film web 16 and to permit the passage of internal illumination, which reflects off the back surface of the web 16.

The end caps 30 each include a flange 33 which radiates beyond the outer surface of the idler roller 28 to the side of the web 16. The flanges 33 guide the web 16 as the web 16 tracks back and forth between the drive and take-up rollers 18, 20. An axle 31 is trained through the end caps 30 and a split through bushing 29 mounts to each end plate 22, 24.

A desired sequence of reverse print, transparent alphanumeric characters 17 are printed to an exposed opaque surface 19 of the web 16. For manually advanced modules 4, the characters are directed into alignment with the viewing windows 7 and proper position is confirmed with visual viewing of the web movement.

For electronically advanced modules 4, markers 34 which define the proper position of the individual characters 17 relative to the window 7, are defined at the edges of the web 16 between the characters 17. The markers 34 are aligned to the lateral sides of each module in the space adjacent the tie rods 26. Appropriate optical detection circuitry 35, reference FIG. 7 monitors the movement of the markers 34 to confirm the location of each of the characters. The master sign controller 37 thus knows which character is being displayed and is able to maintain the proper position of each character relative to the viewing window 7.

Large voids or cutouts 36 are provided at each of the end plates 22, 24. The cutouts 36 in combination with the transparent idler rollers 28 enhance the distribution of light from an illumination source 37, reference FIG. 6. Typically one or more flourescent lamps 38 and a ballast are fitted within the enclosure 6 to provide general back lit illumination that passes through the transparent alphanumeric characters.

Internal reflected light is directed about the enclosure interior through the cutouts 36 and via reflected light from the back of the web 16 and the transparent idler rollers 28. Shadows and light are thereby diminished at each module 4 and between the modules 4 at the interior of the enclosure 6 to optimally highlight the periphery of each displayed character.

Referring to FIG. 4, an exploded assembly drawing is shown to the take-up roller 20. The roller 20 provides constant tension to the web 16. The roller 20 is constructed of a tubular core 40 and interiorly of which a spiral spring 42 concentrically extends along a through axle 44. The core 40 is secured to the end caps 46, 48 with roll pins 58. Flanged hubs or end caps 46, 48 are press fitted to the top and bottom of the core 40. DELRIN bushings 50 are fitted to the top and bottom end plates 22, 24 and through which bolts 52 extend to retain the end caps 46 and 48 and the roller 20 to the module 4. Also provided at each end cap 46, 48 are washers 59 which provide flanged surfaces that extend beyond the core 40 to retain the web 16 on the core 40 in a fashion to the flanges 30.

Tension is maintained on the roller 20 by securing one end of the spring 42 to the end cap 46 with a fastener 54. A stop sleeve 56 at the opposite end of the spring 42 is secured to the axle 44 and mounts to the end cap 48.

A stop limit assembly 57, reference FIG. 2, is fitted to a lower end of the take-up roller 20 to prevent over rotation of the roller 20 when an extreme end of the web 16 is reached. The limit assembly 57 includes a slot 60 that is formed into the lower end of the core 40 and end cap 48 and a latch arm 62 which is spring biased to mount into the slot 60.

The latch arm 62 is retained to the tie rod 26 and is normally prevented from engaging the slot 60 by the intervening web 16 as the latch arm 62 follows the outer surface of the web 16. Once fully extended, the latch arm 62 falls into the slot 60. Rotation is suspended with the latch arm 62 abutting the end of the slot 60. Counter rotation of the roller 20 disengages the arm 62 from the slot 60 and a tapered surface of the arm 62 again follows the web 16. The slot 60 and latch arm 62 thus prevent the web 16 from being detached from the core 40. A similar stop limit 57 having a slot and latch arm (not shown) are provided at the drive roller 18.

As discussed above, each module 4 is adapted to receive either a manual or electric drive assembly at the drive roller 18. The drive roller 18 is essentially the same for either module. The principal distinction between the two modules is the drive operator which is either a pole actuated linkage, such as is manually coupled to bale rings or drive loops 70, 72 as shown at the manual assembly of FIG. 5 or a drive motor 74 that is linked to the drive roller 18.

Referring to FIG. 5, a drive linkage assembly 68 cooperates with a hook end at a pole to provide independent manual drive motion via the bale rings 70, 72 to a pair of vertically stacked modules 4 and which is discussed in more detail below. The drive roller 18 of each module 4 includes a tubular sleeve 76 that is fitted between a pair of flanged end caps 78, 79. The web 16 winds over the sleeve 76 and between end flanges 77.

An axle 80 extends through the center of the sleeve 76 and the end plates 22, 24 and the end caps 78, 79 are secured to the axle 80 with roll pin fasteners. A wave spring 84 and a pair of nuts 86 are fitted to one end of the axle 80 and with the proper displacement of the nuts 86 the spring 84 applies a tension to the axle 80.

Secured to the bottom of the end plate 24 is a hub piece 88 which has a toothed surface 90. Secured, in turn, to the axle 80 with a pair of set screws 92 is a hub driver 94 which includes a concentric over-running toothed surface 96 that interlocks with the teeth at the surface 90. The bias induced by the spring 84 causes the surfaces 90, 96 to normally engage one another and prevent rotation of the web 16 by counter-acting the tension placed on the web 16 by the spring 42.

Upon pulling on the bale ring 72, which is coupled to the hub 94 via an extension piece 97 that is fitted to a coupler 98 at the end of the axle 80 and through the enclosure 6 at a bushing 100, the hub 94 can be separated approximately 3/32 inch from the hub 88 and the roller 18. In response, the tension on the spring 42 at the take-up roller 18 retracts the web 16. The spring 42 is wound such that the web 16 is placed under continuous tension as it is conveyed either clockwise or counter-clockwise over the rollers 18, 20. Alternatively, upon rotating the bale ring 72 in the non-over-running direction with the surfaces 90 and 96 engaged, the roller 18 and web 16 are advanced in an opposite direction. Simultaneously, the tension at the spring 42 is increased. With suitable manipulation of the bale ring 72, each alphanumeric character 17 can be properly positioned at the viewing window 7 of the enclosure 6.

Figure 6:
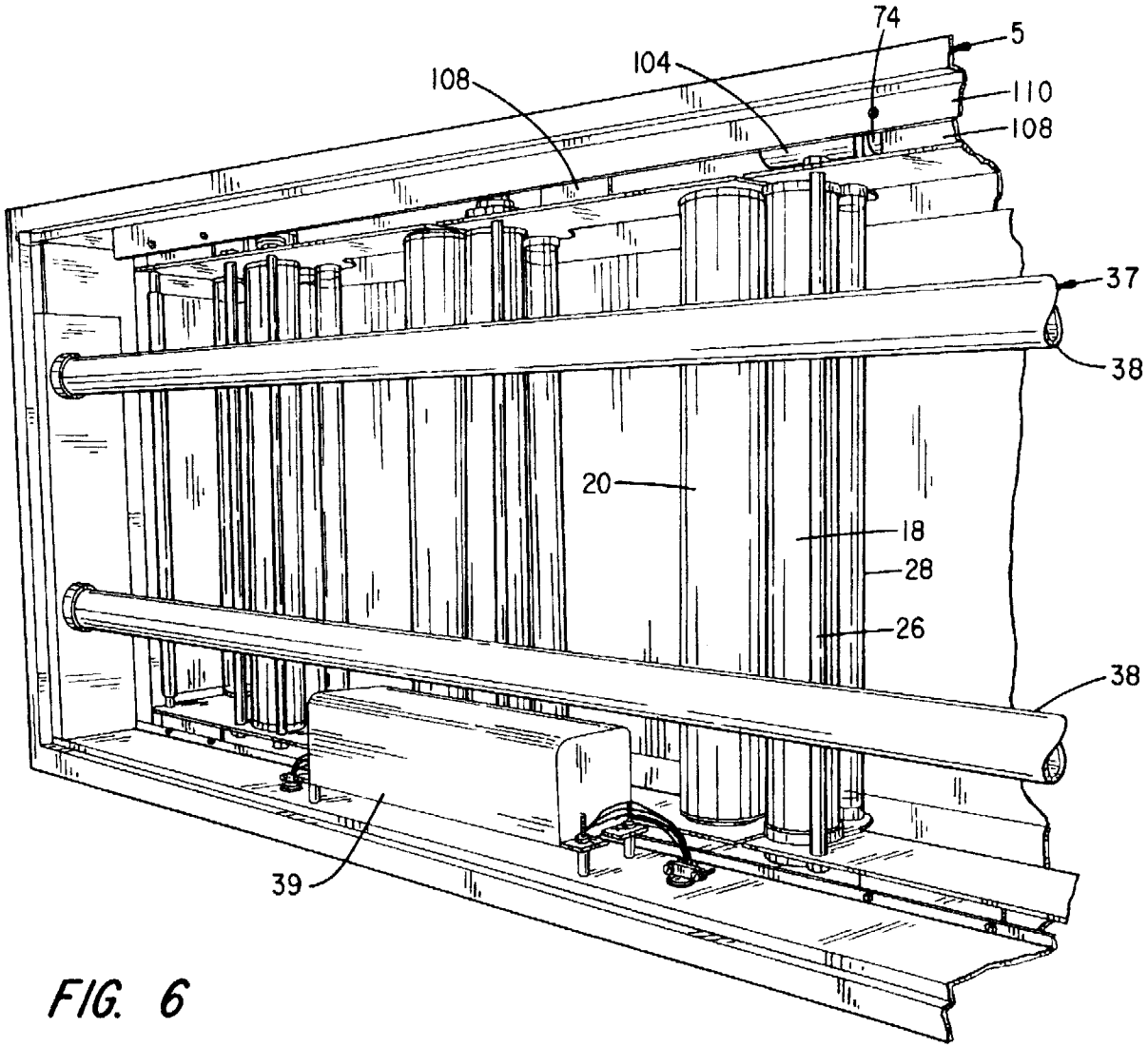
FIG. 6 is a partial perspective drawing to a number of rack mounted modules at a sign enclosure.
Figure 7:
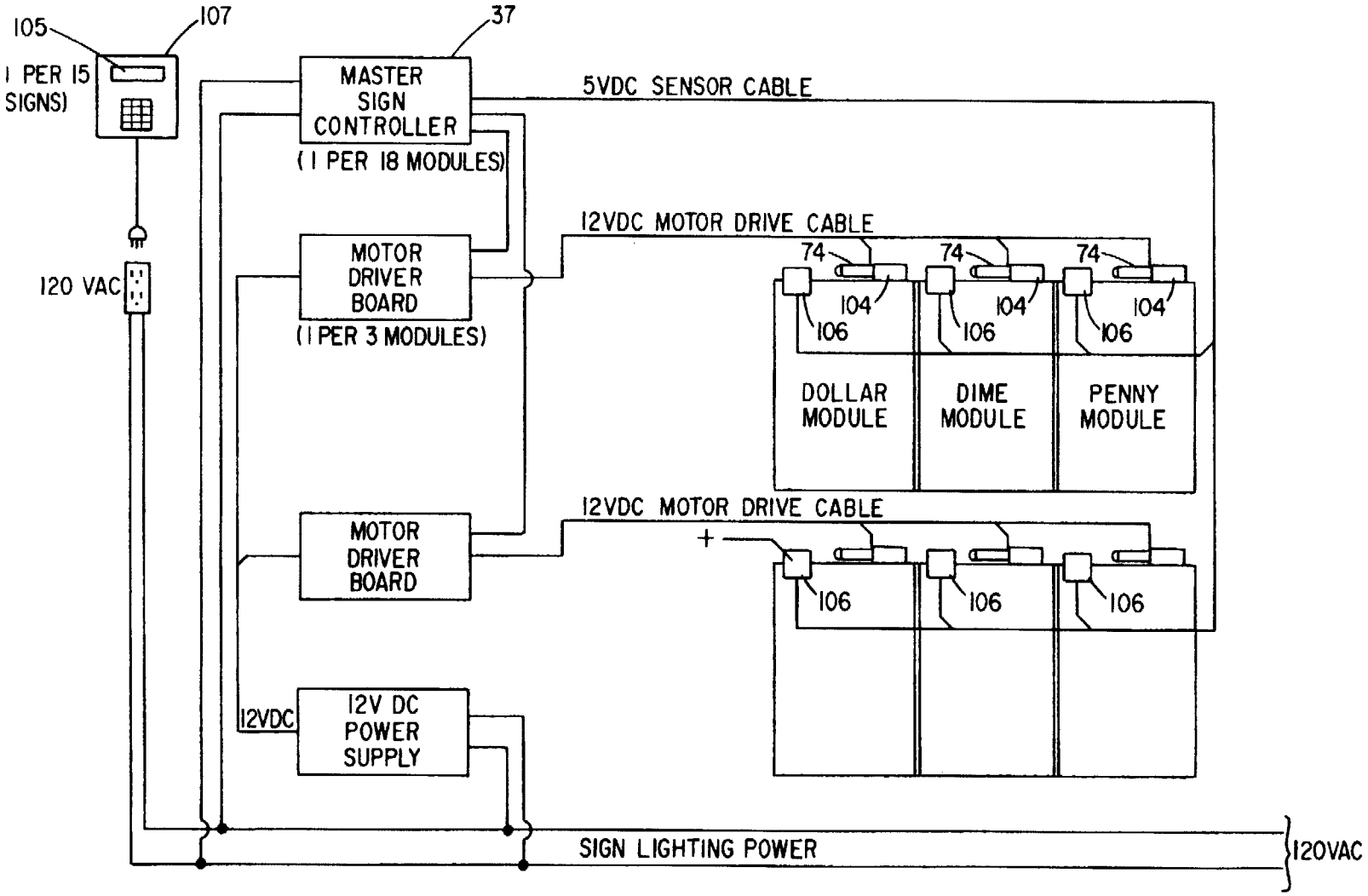
FIG. 7 is a schematic diagram of the controller circuitry for a remotely controlled module.

The bale ring 70 is separately coupled to the axle 80 of the upper module 4 via an extension piece 102 which extends inside the axle 80 of the lower module 4. The extension piece 102 is fitted in a similar fashion to a pair of hubs 88, 94 and a spring biased roller 76 of the upper module 4. Upon appropriately engaging the bale ring 70 a desired character 17 is independently exposed at the upper module 4.

Where an electric drive is included and with attention to FIG. 6 and the schematic diagram of FIG. 7, a conventional DC stepper motor 74 and reduction gear assembly 104 are secured to the end plate 22 and the axle 80 of the drive roller 18 of each module 4. Only one of the motors 74 and gear assemblies 104 are shown at the sign of FIG. 6. A geared surface at the reduction assembly 104 couples to a hub having a mating surface that extends from the axle 80. Rotation is effected with application of positive or negative drive signals to the separate motors 74 to appropriately position the characters, which remain under tension via the spring 42.

A variety of techniques can be used to couple the drive signals to the motors 74, including direct wiring and wireless couplings, such as RF transceivers. The controller 37 instead uses the line voltage conductors that supply power to the sign lighting 37 to distribute power to both the light assembly and the stepper motors 74. Broad band, spread spectrum encoded, amplitude modulated signals are particularly impressed over the AC carrier by the controller circuitry 37 to responsively drive the webs 16 at the various modules 4 preferred distances to expose the desired 20 characters. Infrared sensors 106 at each module monitor the markings 34 to maintain synchronized track of the exposed characters 17 and proper alignment to the viewing window 7.

A programmable keypad 107 permits the sign operator to enter desired functions and data into the controller 37. Once the operator identifies himself/herself with an appropriate password, the operator is particularly prompted to enter the character 17 to be displayed at each module 4 via the programmer 107. Each module and the data to be displayed is sequentially entered. The entered data is confirmed at a display 105 and the operator is provided an opportunity to vary the value prior to initiating a defined movement at the identified module 4. Although the operation of the processor at the controller 37 has been described in relation to a basic programming sequence, a variety of functions and sequences may alternatively be supported and selected by the operator via the keyboard 107.

With attention also to FIG. 6 and mounted to the end plates 22, 24 are drilled end brackets 108. The brackets 108 are positioned to fasten the modules 4 to track rails 110 at the enclosure at preferred spacings. The tracks 110, in turn, are fastened to the walls of the enclosure 6. One or more sets of tracks 110 can be mounted to the enclosure 6 in any variety of organizations. Depending upon the sign organization, the some modules 4 may be manually directed with or without a cooperating linkage 68 and some may be electrically directed.

Although the invention has been described with respect to a presently preferred construction in various considered modifications and improvements, it is not inconceivable other constructions will be suggested to those skilled in the art. The following appended claims should accordingly be interpreted to include all those equivalent embodiments within the spirit and scope thereof.

What is claimed is:

1. Sign apparatus comprising:

a) a support frame including first and second displaced end plates and means for retaining said end plates to a surrounding enclosure, and wherein said enclosure includes an illumination source mounted behind a viewing window;

b) a web having first and second ends and including a plurality of transparent alphanumeric characters in an opaque field trained between said illumination source and said viewing window and wherein each character is positioned to the web to be visible at the viewing window;

c) a plurality of transparent idler rollers secured to rotate at said first and second end plates, wherein each idler roller includes a radially extending flange at each end, and wherein said web is trained about said idler rollers and guided by said flanged ends;

d) a take-up roller secured to said first end of said web and mounted to rotate at said first and second end plates and including spring means for tensioning said web in a first direction;

e) a drive operator; and f) a drive roller secured to said second end of said web and mounted to rotate at said first and second end plates and including clutch means engageable with said drive operator and operative in a first position for rotating said drive roller in a second direction opposite to said first direction and for increasing the tension on said take-up roller and in a second position for permitting the tension of said take-up roller to direct web rotation in the first direction.

2. Apparatus as set forth in claim 1 wherein said drive roller includes first and second axially displaceable hubs, wherein each hub includes concentrically aligned geared surfaces, and wherein said geared surfaces rotate in unison in said second direction.

3. Apparatus as set forth in claim 2 wherein said first and second hubs are spring biased into engagement with one another and wherein said drive operator comprises pole means for rotating and axially separating said first and second hubs.

4. Apparatus as set forth in claim 3 wherein said first hub is mounted to an end plate and said second hub is mounted to a first axle concentric to said first hub and which first axle rotatively supports said drive roller.

5. Apparatus as set forth in claim 4 wherein a second axle is mounted concentric to said first axle and engages a second hub of a second drive roller that supports a second web.

6. Apparatus as set forth in claim 3 wherein said take-up and drive rollers each include a pair of radially extending end flanges which support peripheral edges of said web.

7. Apparatus as set forth in claim 1 wherein first and second idler rollers are mounted to said first and second end plates in lateral displacement and in the plane of said viewing window, and wherein cut outs are formed in the end plates behind said web, whereby light within said enclosure can reflect through said idler rollers and pass through the end plates.

8. A sign module comprising;

a) a support frame including first and second displaced end plates and means for retaining said end plates to a surrounding enclosure, wherein said enclosure includes an illumination source mounted behind a viewing window and further including an alphanumeric module comprising;

b) a web having first and second ends and including a plurality of transparent alphanumeric characters defined in an opaque field trained between said illumination source and said viewing window and wherein each character is positioned at the web to be visible at the viewing window;

c) a plurality of transparent idler rollers secured to rotate at said first and second end plates, wherein each idler roller includes a radially extending flange at each end, and wherein a peripheral edge of said web is trained about said idler rollers and guided by said flanged ends;

d) a take-up roller secured to said first end of said web and mounted to rotate at said end plates and including a torsion spring mounted internally of a cylindrical body tube for tensioning said web in a first direction;

e) a drive roller secured to said second end of said web and mounted to rotate at said first and second end plates and including first and second axially displaceable hubs, wherein said first and second hubs are spring biased into engagement with one another, wherein said first and second hubs include concentrically aligned geared surfaces, wherein said geared surfaces interlock; and f) pole means operative in a first position for rotating said drive roller in a second direction opposite to said first direction and for increasing the tension on said take-up roller and in a second position for axially separating said first and second hubs such that the tension of said take-up roller directs web rotation in the first direction.

9. Apparatus as set forth in claim 8 wherein first and second ones of said modules are mounted in overlying relation to one another to a frame mounted within said enclosure.

10. Apparatus as set forth in claim 9 wherein first and second axles at first and second drive rollers are mounted concentric to one another and accessible to said pole means, whereby the alphanumeric characters at said first and second modules are independently adjustable.

* * * * *